United States Patent [19]

Hand

[11] 3,934,448

[45] Jan. 27, 1976

[54] RACKED PIPE REAMER

[76] Inventor: Lowal L. Hand, 416 S. 4th, Clinton, Okla. 73601

[22] Filed: Nov. 25, 1974

[21] Appl. No.: 527,184

[52] U.S. Cl. ..... 72/380; 72/392

[51] Int. Cl.[2] ..... B21D 5/02

[58] Field of Search ..... 72/380, 370, 447, 479, 72/392, 393; 254/147, 184; 29/244, 252, 282, 283; 61/72.1, 63; 15/104.2; 408/234, 236, 237; 175/406, 407

[56] References Cited

UNITED STATES PATENTS

| | | | |
|---|---|---|---|
| 1,623,405 | 4/1927 | Gocke et al. | 72/392 |
| 1,623,657 | 4/1927 | Brown | 72/392 |
| 2,697,469 | 12/1954 | Becroft | 72/380 |
| 2,708,471 | 5/1955 | Ballard | 72/380 |

*Primary Examiner*—C. W. Lanham
*Assistant Examiner*—James R. Duzan
*Attorney, Agent, or Firm*—Robert K. Rhea

[57] ABSTRACT

A mobile base longitudinally slidably supports a platform and transversely supports an elongated winch cable and pipe reamer supporting trough, in elevated relation. Fluid operated cylinders moves the platform and axially aligns the trough with tubular members to be reamed. An elongated reamer moving rod is connected at its respective ends with winch cables in turn connected, respectively, with a pair of fluid motor sequence operated winches alternately pushing and pulling the rod and reamer into and out of tubular members.

6 Claims, 6 Drawing Figures

RACKED PIPE REAMER

BACKGROUND OF THE INVENTION

1. Field of the Invention.

The present invention relates to tubular checking means and more particularly to an apparatus for running a reamer, or the like, through the bore of casing or pipe.

It has been common practice to transport tubular members, such as casing or pipe, to a service center for cleaning and other functions, such as checking its inside diameter for flattened or out-of-round condition by running a reamer, or the like, therethrough. While some of the operations performed on pipe when being reconditioned, such as rethreading or pressure testing, require the pipe to be placed in a shop having facilities for such operations it is usually unnecessary where the operations on the pipe are running a reamer therethrough to clean out easily dislodged obstructions or for checking the inside diameter for "flat"spots. These latter operations are preferably performed in the field and has usually been done by manually extending or pushing a "rabbit" or reamer-like tool coaxially connected to one end of an elongated rod through each joint of pipe. This is, at best, a time consuming operation.

This invention provides an apparatus for passing a reamer, or the like, through each joint of pipe, or the like, when the pipe or a plurality thereof is horizontally disposed, such as on a rack.

SUMMARY OF THE INVENTION

An elongated mobile frame forming a substantially horizontal base is disposed with its longitudinal axis normal to the axis of and spaced from the ends of a plurality of tubular members stacked or supported in vertical layers in pipe rack fashion. A platform overlies the base in slidable relation and is movable longitudinally by a pressure cylinder. Other upstanding pressure cylinders horizontallly support a trough means having its axis parallel with the axes of the racked pipe. The trough means is movable vertically for axial alignment with the respective pipe length by the other cylinders. An elongated rod is slidably supported by the trough means and is reciprocated therein by a pair of fluid motor driven winches connected, respectively, with opposing ends of the rod by flexible elements. A reamer, or the like, is coaxially connected with the end of the rod adjacent the racked pipe. Rotation of one of the winches pushes the reamer into and through the bore of one joint of pipe while the other winch "freewheels" and permits an unwinding action of the flexible element wound on its drum. Rotation of the other winch, to withdraw the reamer by pulling the rod out of the pipe joint is an equal and opposite action of the winches. An engine operated compressor maintains pressure in a reservoir of cylinder operating fluid.

The principal object of this invention is to provide a mobile apparatus having vertically and horizontally adjustable guide means for reciprocating a reamer through a succession of joints of racked pipe.

DESCRIPTION OF THE PREFERRED EMBODIMENT

Figure 1:
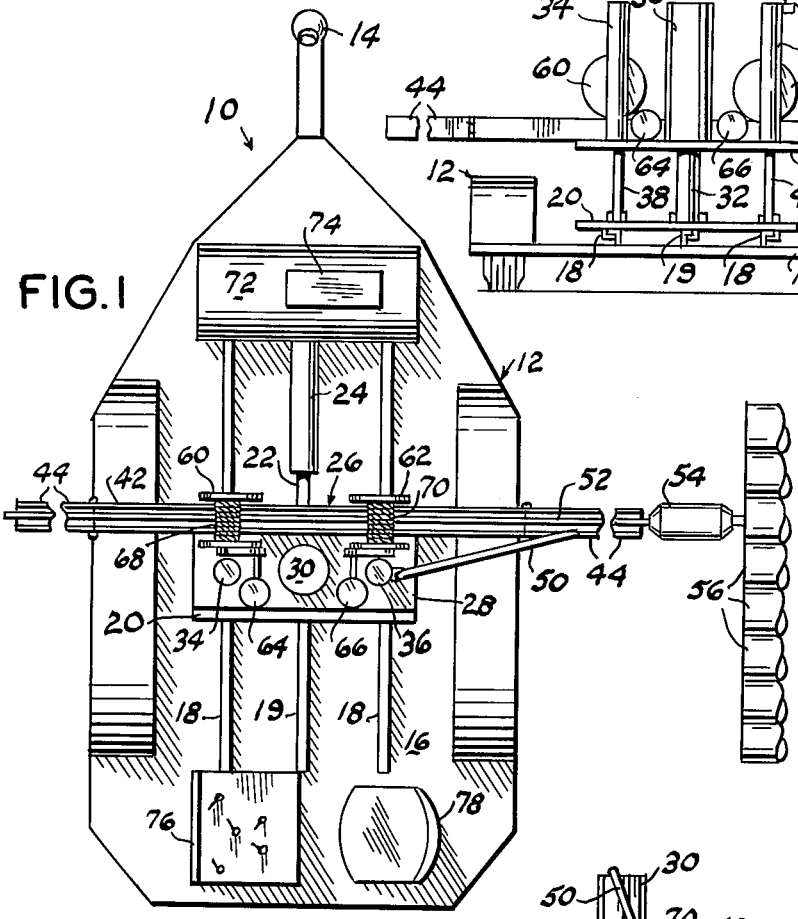
FIG. 1 is a fragmentary top view of the apparatus.
Figure 3:
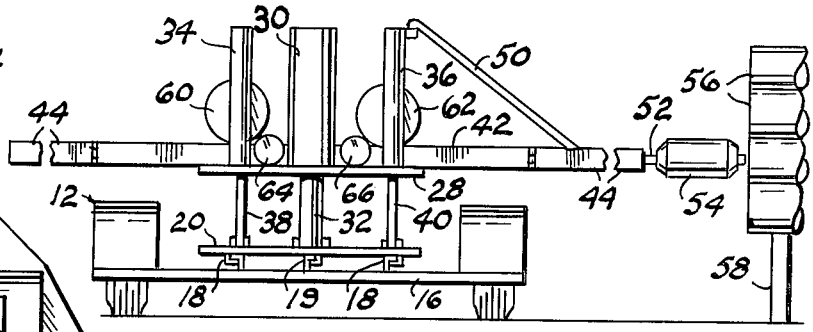
FIG. 3 is a rear end elevational view with the seat, control panel and pressure tank removed for clarity.
Figure 2:
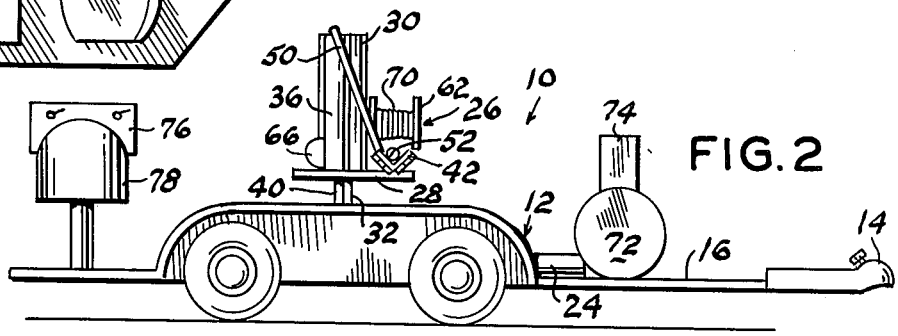
FIG. 2 is a right side elevational view of FIG. 1.

Like characters of reference designate like parts in those figures of the drawings in which they occur.

In the drawings:

The reference numeral 10 indicates a wheel supported trailerlike device comprising a frame 12 provided with a trailer hitch 14 for towing behind a prime mover. The frame 12 is characterized by a horizontal base 16 having a plurality, three in the example shown, of longitudinally extending laterally spaced-apart parallel side rails 18 and a center rail 19 which slidably support a longitudinally movable platform 20. The forward end portion of the platform 20 is connected with the piston rod 22 of a platform moving pressure cylinder 24 for the purposes presently explained.

Figure 5:
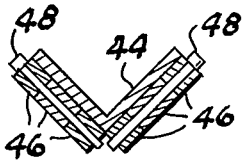
FIG. 5 is a vertical cross sectional view, to a larger scale, taken substantially along the line 5—5 of FIG. 4.
Figure 4:
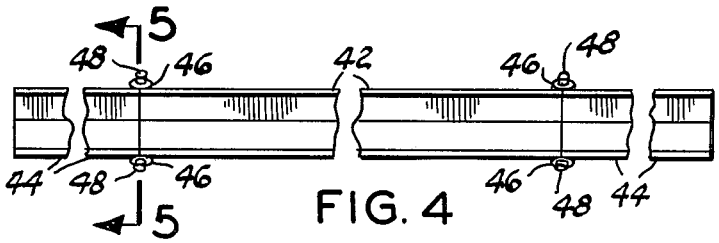
FIG. 4 is a fragmentary top view, to an enlarged scale, of the push rod supporting trough, per se.
Figure 6:
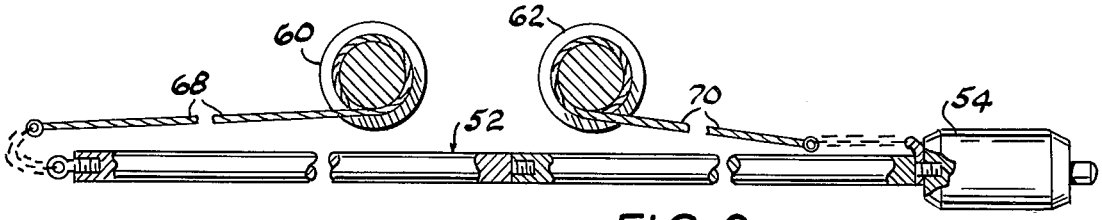
FIG. 6 is a fragmentary elevational view, partially in section, of the push rod means and diagrammatically illustrating a pair of winches operatively connected therewith.

Trough means 26 is transversely supported for vertical movement above the frame 12 and comprises a trough support 28 secured to the depending end portion of a master cylinder 30 having its piston rod 32 secured to the platform 20 above the central rail 19. A pair of secondary or adjusting cylinders 34 and 36 are respectively disposed laterally of the master cylinder 30 and are similarly connected with the trough support 28 with their respective piston rods 38 and 40 similarly connected with the platform 20 above the respective rail 18. The trough support 28 supports a trough central section 42 which is V-shaped in cross section (FIG. 5) and formed by a plurality of extension sections 44 of angle iron, or the like, connected to the respective ends of the center section. Meeting ends of the sections 42 and 44 are secured or joined together by cooperating aligned centrally drilled lugs 46 arranged on each flange of the angle iron shape in interdigitated relation and secured by a pin 48. A support brace 50, connected with the upper end of the cylinder 36 and adjacent section 44, aids in supporting the axis of the trough horizontally.

An elongated threadedly connected sectional push rod 52 is slidably supported longitudinally by the trough. One end of the push rod is coaxially connected with a reamer 54, or the like, dimensioned for entering and passing through the bore of casing or pipe 56 supported by a rack 58 laterally of the frame 12. A pair of winches 60 and 62 are supported by the trough support 28 and are driven by a pair of air motors 64 and 66, respectively. A flexible element, such as a cable 68, is connected, at one end, to one end of the rod member 52 and wound at its other end portion around the drum of the winch 60. Similarly, a second cable 70 is connected, at one end, to the other end portion of the rod 52 adjacent the reamer and wound at its other end portion around the drum of the winch 62. Fluid pressure, such as air, is supplied to the cylinders and air motors from a reservoir 72 mounted on the forward end of the base 16 including a gasoline driven engine and compressor 74 for maintaining the reservoir filled with air under a predetermined pressure. Flexible lines, not shown, connect the reservoir 72 to the respective cylinders and air motors through a control panel 76 mounted on the rearward end portion of the base 16 adjacent an operator's seat 78. Obviously hydraulic fluid may be used as a motor and cylinder operating medium.

OPERATION

In operation, the apparatus 10 is positioned with its longitudinal axis normal to the axis of the pipe 56 to be reamed or cleaned with the trough sections 44 assembled in place. Coaxial alignment of the rod 52, with the axis of a selected pipe 56, is achieved by forward or rearward movement of the platform 20 by the cylinder 24 and vertical movement of the trough means 42 by the master cylinder 30. The secondary cylinders 34 and 36 are selectively operated to position the axis of the trough means in horizontal alignment with the axis of the selected pipe in a tilting action of the trough support 28 to compensate for irregularities in the surface of the earth adjacent the pipe rack. The motor 64 operating the winch 60 winds the cable 68 thereon and pulls the rod end portion, opposite the reamer, longitudinally through the trough and extends the reamer and rod 52 into the pipe in a pushing action wherein the winch 62 simultaneously unwinds its cable 70 in a free-wheeling action to permit the end portion of the cable 70, connected with the rod 52, to also enter the pipe. When the reamer 54 appears at the opposite end of the pipe, the motor 64 is stoppped and the motor 66 operated so that its winch 62 winds up the cable 70 and pulls the rod 52 and reamer out of the pipe while the winch 60 releases its cable 68. The reamer 54 is thus reciprocated at least once through each joint of pipe by repeating the above described cycle.

Obviously the invention is susceptible to changes or alterations without defeating its practicability, therefore, I do not wish to be confined to the preferred embodiment shown in the drawings and described herein.

I claim:

1. A reamer for horizontally disposed racked tubular members, comprising:

an elongated mobile frame including a substantially horizontal base;

a platform longitudinally slidably overlying said base;

platform moving means for moving said platform relative to said base;

trough means extending transversely of said base in vertically spaced relation above said platform;

elevating means for raising and lowering said trough means;

a reamer rod slidably supported by said trough;

a reamer connected with one end of said rod;

a pair of winches each having a flexible element connected with one end of said rod in cooperative opposition; and, means including motors for operating said winches, whereby operation of said winches in sequence alternately pushes said rod and reamer into and through and pulls it back out of the same end of a racked tubular member.

2. The reamer according to claim 6 in which said platform moving means includes:

a fluid operated platform cylinder connected at one end with said base and connected at its other end with said platform.

3. The reamer accordng to claim 4 in which said trough means includes:

a trough support; and, a plurality of elongated trough sections longitudinally supported in end to end relation by said trough support.

4. The reamer according to claim 1 in which said elevating means includes:

a source of fluid pressure; and, a vertically disposed master cylinder having the depending end of its piston rod secured to said platform and having the depending end of its cylinder body secured in supporting relation to said trough means.

5. The reamer according to claim 3 and further including: at least one secondary vertically disposed elevating cylinder having the depending end of its piston rod secured to said platform and having the depending end of its cylinder body secured to one end portion of said trough support for raising and lowering said one end portion of said trough support with respect to its opposite end portion.

6. The reamer according to claim 5 in which said source of fluid pressure includes:

a reservoir; and, pump means maintaining a supply of fluid under greater than atmospheric pressure in said reservoir.

* * * * *